US008438760B2

(12) United States Patent
Maher et al.

(10) Patent No.: US 8,438,760 B2
(45) Date of Patent: May 14, 2013

(54) MECHANICAL ATTACHMENT SYSTEM AND ASSOCIATED FAILURE MECHANISM

(75) Inventors: Patrick Gerard Maher, Naval Base (AU); Benjamin Hughes, Canning Vale (AU)

(73) Assignee: Sandvik Mining and Construction Australia (Production/Supply) Pty Ltd., Queensland (AU)

( * ) Notice: Subject to any disclaimer, the term of this patent is extended or adjusted under 35 U.S.C. 154(b) by 66 days.

(21) Appl. No.: 12/339,612

(22) Filed: Dec. 19, 2008
(Under 37 CFR 1.47)

(65) Prior Publication Data

US 2009/0282711 A1 Nov. 19, 2009

Related U.S. Application Data

(63) Continuation-in-part of application No. 10/509,016, filed as application No. PCT/AU03/00362 on Mar. 26, 2003, now Pat. No. 7,472,503.

(30) Foreign Application Priority Data

| | | |
|---|---|---|
| Mar. 26, 2002 | (AU) | PS1348 |
| Jul. 12, 2002 | (AU) | 2002950166 |
| Dec. 8, 2008 | (AU) | 2008906335 |

(51) Int. Cl.
*E02F 9/28* (2006.01)

(52) U.S. Cl.
USPC ..... 37/457; 403/374.1

(58) Field of Classification Search ..... 37/446–460; 403/374.3, 374.4, 374.1, 379.3, 379.4
See application file for complete search history.

(56) References Cited

U.S. PATENT DOCUMENTS

| | | | | |
|---|---|---|---|---|
| 1,485,879 | A | | 3/1924 | Page |
| 1,697,536 | A | | 1/1929 | Miley |
| 1,783,350 | A | | 12/1930 | James |
| 2,055,265 | A | * | 9/1936 | Swigert, Jr. ..... 37/456 |
| 2,311,463 | A | | 2/1943 | Page |
| 2,385,395 | A | | 9/1945 | Baer |
| 2,393,706 | A | | 1/1946 | Page |
| 2,483,032 | A | * | 9/1949 | Baer ..... 37/457 |
| 2,996,291 | A | * | 8/1961 | Krekeler ..... 299/109 |
| 3,085,812 | A | * | 4/1963 | Rosenthal et al. ..... 279/4.06 |
| 3,371,437 | A | | 3/1968 | Wilson et al. |
| 3,967,399 | A | * | 7/1976 | Heinold et al. ..... 37/458 |
| 4,163,581 | A | * | 8/1979 | Krekeler ..... 299/102 |
| 4,205,469 | A | | 6/1980 | Johansson et al. |

(Continued)

FOREIGN PATENT DOCUMENTS

| | | |
|---|---|---|
| AU | 41363/85 | 10/1985 |
| AU | 74126/94 | 5/1995 |
| WO | WO-02/12642 | 2/2002 |

*Primary Examiner* — Jamie L McGowan
(74) *Attorney, Agent, or Firm* — Venable LLP; Robert Kinberg

(57) ABSTRACT

An attachment system for connecting a first member such as a lip plate of a mechanical digging device to a second member such as a ground engaging tool. The first member has a lug attached thereto, and the second member has a recess which is located about the lug A stabilizing member is located within a slot in the recess. A clamping member is between the lug and the stabilizing member, and includes a resilient portion such as a compression spring. A compressive force supplied to the resilient portion restricts the movement of the second member relative to the lug.

13 Claims, 10 Drawing Sheets

U.S. PATENT DOCUMENTS 4,576,504 A * 3/1986 Hartman ..... 403/318
4,642,920 A 2/1987 Lehnhoff
4,748,754 A 6/1988 Schwappach
5,077,918 A * 1/1992 Garman ..... 37/452
5,564,206 A * 10/1996 Ruvang ..... 37/458
5,579,594 A 12/1996 Pasqualini et al.
5,605,382 A * 2/1997 Massa ..... 299/107
5,653,048 A * 8/1997 Jones et al. ..... 37/452
5,713,145 A 2/1998 Ruvang
5,784,813 A * 7/1998 Balassa et al. ..... 37/455
5,926,982 A 7/1999 Keech et al.
6,209,238 B1 4/2001 Ruvang
6,240,663 B1 6/2001 Robinson
6,439,796 B1 * 8/2002 Ruvang et al. ..... 403/157
6,729,052 B2 5/2004 Ollinger et al.
6,839,990 B2 1/2005 Leslie et al.
7,165,347 B2 * 1/2007 Ollinger et al. ..... 37/452

* cited by examiner

MECHANICAL ATTACHMENT SYSTEM AND ASSOCIATED FAILURE MECHANISM

CROSS-REFERENCE TO RELATED APPLICATION

This application is a Continuation-in-Part of application Ser. No. 10/509,016 filed Apr. 7, 2005 which is a National Stage Application of PCT/AU03/00362 filed Mar. 26, 2003, and claims the priority of Australian Application No. PS1348, filed Mar. 26, 2002, and Australia Application No. 2002950166, filed Jul. 12, 2002, both priorities being claimed herein. The priority of Australian Provisional Application No. 2008906335, filed Dec. 8, 2008 is also claimed herein. The entire content of the foregoing earlier applications is incorporated herein by reference.

FIELD OF THE INVENTION

The present invention relates to mechanical connections of wear parts to underlying structures. It has been created in connection with the connection of ground engaging tools to buckets of earth-moving equipment.

BACKGROUND OF THE INVENTION

Many mining and earthmoving operations require the use of mechanical digging devices, such as front-end loaders. Such mechanical digging devices commonly feature buckets which can be manipulated by a user to dig into earth or rocks to be shifted. These buckets include a lip plate across the bucket floor. On this lip are mounted a series of ground engaging tools (GET) having a tooth-like appearance. These tools, in use, penetrate into the material being dug, and provide a leading edge for the bucket to follow.

Ground engaging tools (GET), for earth-moving equipment, such as those used in mining operations, operate in a highly abrasive environment and are subject to significant wear. GET such as bucket teeth thus require regular replacement.

Traditionally, GET are welded onto the lips of buckets. When the GET come to the end of their useful life, they can be cut from the bucket, and new GET welded in their place.

It will be appreciated that the cutting and re-welding operation is complex, time-consuming and relatively expensive. Further, it must generally be done in a workshop, requiring the earth-mover bucket to be transported away from the earth-moving equipment.

Various mechanical attachment methods have been proposed in an attempt to alleviate these problems. Many of the methods involve the use of bolts and similar fastening devices, inserted within the lip of the bucket. In general, such devices have proved to be of limited use. The insertion of a bolt or similar within a bucket lip can lead to undesirable stress concentrations within the lip, resulting in cracking of the bucket lip. Even where this is avoided, the large forces to which GET are exposed in use have a tendency to deform connecting bolts, thus making their subsequent extraction using mechanical tools difficult. Indeed, in some cases the deformation can be so severe that the GET must be cut away, completely negating any advantage of mechanical connection.

An object of the present invention is to provide a reusable means of mechanical attachment for ground engaging tools.

SUMMARY OF THE INVENTION

In accordance with one aspect of the present invention there is provided an attachment system for connecting a first member to a second member, characterised in that the first member has a lug connected thereto, the second member has an recess which receives the lug in use, and wherein a clamping member is disposed between the lug and the second member, the clamping member including a resilient portion such that the supply of a compressive force to the resilient portion acts to restrain movement of the second member relative to the lug.

In accordance with a second aspect of the present invention there is provided an attachment system for connecting a first member to a second member, characterised in that the first member has a lug connected thereto, the second member has an recess which receives the lug in use, the recess including a slot arranged to receive a stabilizing member, and wherein a clamping member is disposed between the lug and the stabilizing member such that the supply of pressure to the clamping member acts to restrain movement of the second member relative to the lug.

In a further aspect, the invention achieves an important effect by providing a failure mode for mechanical connection devices which does not result in seizure of the locking device.

In accordance with a third aspect of the present invention there is provided a clamping member for use in an attachment system, the clamping member having a body, a force applying member and a compressing member, such that the application of force by the force applying member causes the compressing member to protrude from a first side of the body, and where the relative hardnesses of the body, the force applying member and a compressing member are such that the application of a sufficiently large axially applied force to the protruding portion of the compressing member will preferentially cause deformation of the protruding portion of the compressing member ahead of deformation of the body or the force applying member.

If deformation of the clamping member occurs as deformation of the protruding portion of the compressing member, the clamping member can still function as required, and also be readily removed.

Preferably, the force applying member is located in a threaded connection extending internally of a second side of the body, the second side of the body being opposite the first side. It is preferred that the force applying member is substantially axially aligned with the compressing member.

The compressing member may be substantially cylindrical in shape. In a preferred embodiment, the compressing member has a bevelled outer edge, located within the protruding portion. This allows a small degree of plastic deformation of the compressing member to occur without significantly affecting operation of the clamping member.

In accordance with a fourth aspect of the present invention there is provided an attachment system for connecting a ground engaging tool to a bucket lip, the bucket lip having a lug attached thereto, the ground engaging tool having a recess which receives the lug in use, a clamping member being disposed, in use, between the lug and the ground engaging tool, the clamping member having a body, a force applying member and a compressing member, such that the application of force by the force applying member causes the compressing member to protrude from a first side of the body and to engage the lug, and where the relative hardnesses of the lug, the body, the force applying member and the compressing member are such that the application of a sufficiently large axially applied force via the lug to the protruding portion of the compressing member will preferentially cause deformation of the protruding portion of the compressing member ahead of deformation of the body or the force applying member.

BRIEF DESCRIPTION OF THE DRAWINGS

It will be convenient to further describe the invention with reference to preferred embodiments of the attachment system of the present invention. Other embodiments are possible, and consequently, the particularity of the following discussion is not to be understood as superseding the generality of the preceding description of the invention. In the drawings.

DESCRIPTION OF THE INVENTION

Figure 1:
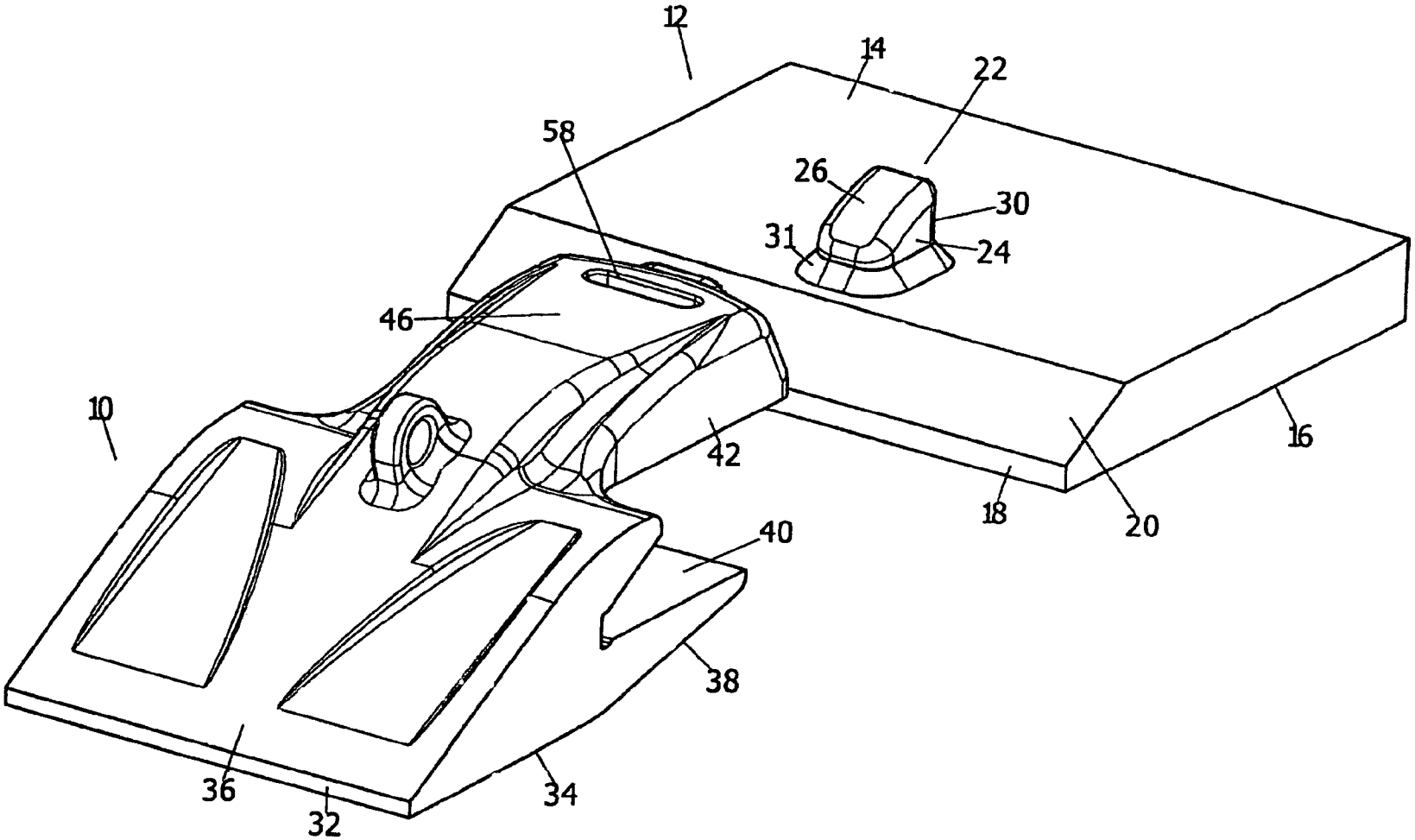
FIG. 1 is a perspective of a ground engaging tool arranged to be attached to a lip plate (a portion of which is shown) in accordance with the present invention.
Figure 2:
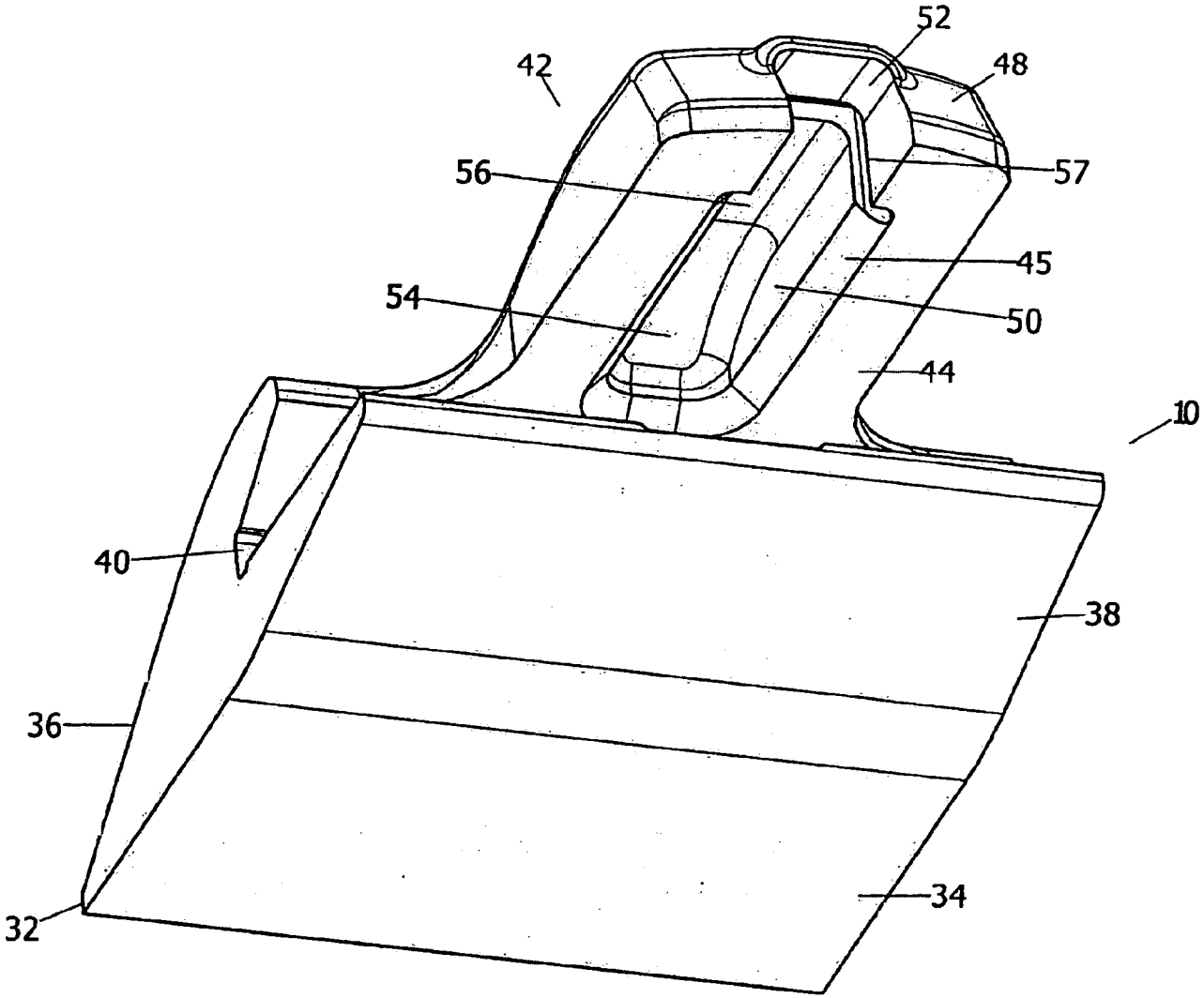
FIG. 2 is a perspective of the underside of the ground engaging tool of FIG. 1.
Figure 3:
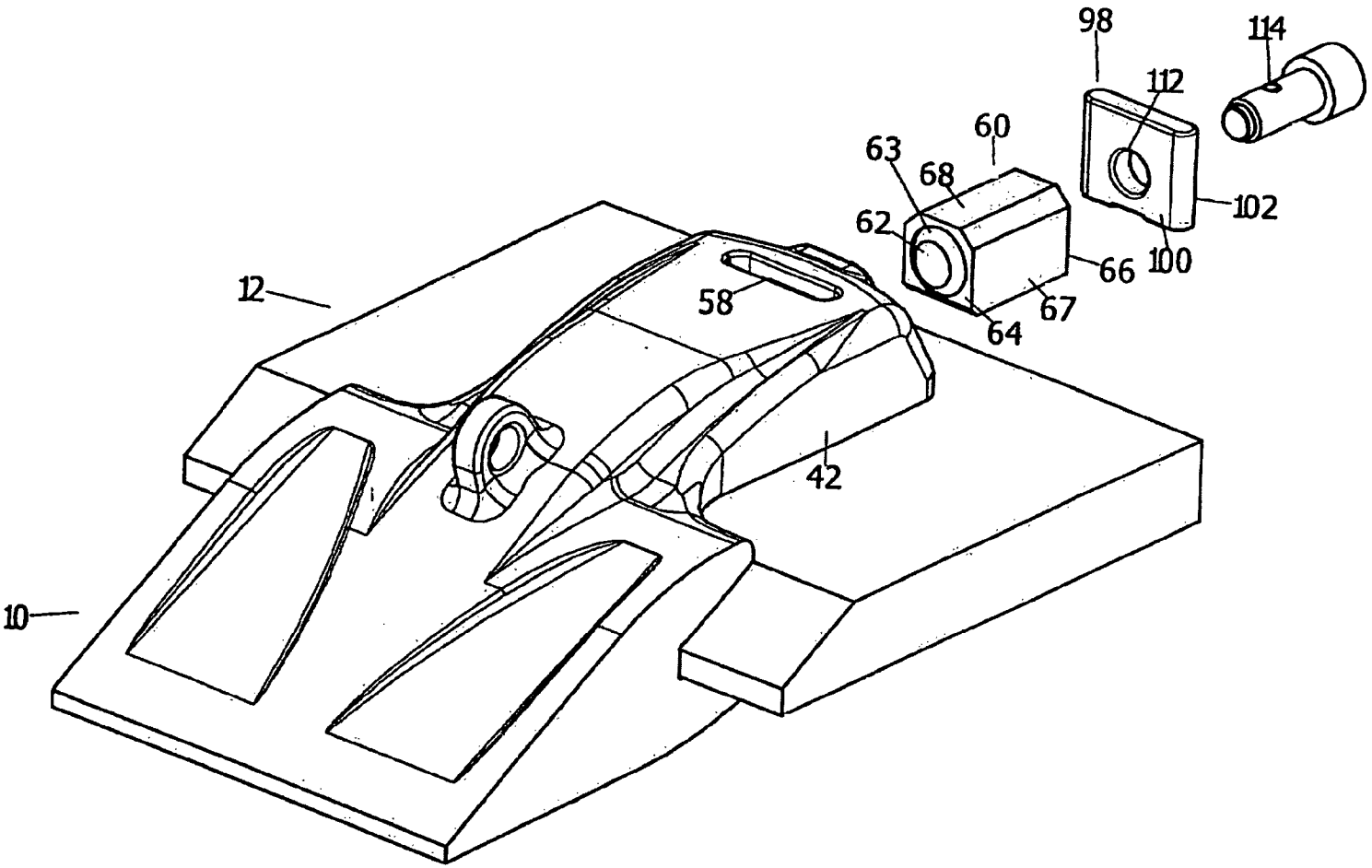
FIG. 3 is a perspective of the ground engaging tool and lip plate portion of FIG. 1, shown during attachment, together with a clamping member in accordance with the present invention.

Referring to the Figures, there is shown a ground engaging tool 10 arranged to be attached to a portion of a lip plate 12. The lip plate 12 is substantially rectangular in cross section, and extends around the rim of a bucket (not shown) of a mechanical digging device. The lip plate 12 includes an upper face 14, a lower face 16 and an end face 18. A tapered surface 20 extends from the end face 18 of the lip plate 12 to the upper face 14.

The lip plate 12 includes a lug 22 affixed by suitable means to the upper face 14. In the embodiment shown in the drawings the lug 22 is affixed by a weld 31. The lug 22 is oriented towards the end face 18 of the lip plate 12, and includes a top surface 26 which curves upwardly in a convex fashion from a first end of the lug 22 adjacent the tapered surface 20 to a second end of the lug 22 remote from the tapered surface 20.

The lug 22 further includes a substantially flat rear face 30 at the second end of the lug 22, the rear face 30 extending from the top surface 26 to the upper face 14, and being substantially perpendicular to the upper face 14 and parallel to the end face 18.

The lug 22 has a side wall 24 which extends about the lug 22 and is bordered by the upper face 14, the top surface 26 and the rear face 30.

The ground engaging tool 10 comprises a leading edge 32, a first base portion 34 extending substantially perpendicularly of the leading edge 32, a front portion 36 extending away from the leading edge at a shallow angle, a second base portion 38 extending away from the first base portion 34 at a shallow angle, a transverse recess 40 disposed oppositely the leading edge 32 and an attachment portion 42. The front portion 36, leading edge 32 and the first base portion 34 co-operate to form a substantially V shaped working portion in order to penetrate, in use, the material being dug. The transverse recess 40 is complementary in shape to the lip plate 12, and allows the ground engaging tool 10 to be located on the perimeter of the lip plate 12 adjacent the end face 18. The second base portion 38 tapers from the first base portion 34 in a direction away from the leading edge 32, and ends, in use, adjacent the lip plate 12. The leading edge 32, first and second base portions 34 and 38 and the front portion 36 define a working portion of the ground engaging tool 10.

The attachment portion 42 extends from the front portion 36 adjacent the recess 40 in a direction away from the leading edge 32. It locates, in use, along the upper face 14 of the lip plate 12, and co-operates with the lug 22.

The attachment portion 42 has a substantially flat lower surface 44, a substantially flat upper surface 46 and a rear surface 48. The attachment portion 42 includes an engaging recess 50 extending inwardly of the rear surface 48 through a rear aperture 52 in the rear surface 48, and upwardly of the lower surface 44 through a lower aperture 45. The engaging recess 50 has a first portion 54 remote from the rear aperture 52, and a second portion 56 adjacent the rear aperture 52. The first portion 54 is complementary in shape to the lug 22, whereas the second portion 56 has substantially constant cross section. The second portion 56 is in the shape of a radiused rectangle in cross section, and is slightly larger in dimension than the rear face 30 of the lug 22. This allows, in use, the second portion 56 to be placed about the lug 22. This in turn allows the attachment portion 42 to be slid over the lug 22 in a longitudinal direction, and to locate in a position whereby the lug 22 is within the first portion 54 of the engaging recess 50. In this position relative movement of the attachment portion 42 and the lip plate 12 in a transverse direction is restricted.

The attachment portion 42 further includes a rectangular slot 57 which extends from an aperture 58 within the upper surface 46 to the lower surface 44.

The rectangular slot 57 is arranged in a transverse direction, and is located within the second portion 56 of the engaging recess 50. The rectangular slot 57 is larger in the transverse direction than the second portion 56, and therefore forms a groove on either side of the second portion 56. The aperture 58 communicates with the second portion 56 of the engaging recess 50.

The attachment system further includes a clamping member 60. The clamping member 60 is shown in FIGS. 3 to 8. The clamping member 60 has a body 61.

The clamping member 60 is of complementary cross sectional shape to the second portion 56 of the engaging recess 50 and has a first side 64 which is arranged to locate adjacent the lug 22 and a second side 66 opposite the first side 64. The second side 66 is arranged to locate adjacent the rectangular slot 57. The clamping member 60 further includes side surfaces 67 and a top surface 68.

The clamping member 60 includes a substantially cylindrical chamber 80 extending within the clamping member 60 from the first side 64 to a rear wall 82.

The clamping member 60 further includes a substantially cylindrical lug engaging member 62. The lug engaging member 62 is substantially complementary in shape to, and contained within, the chamber 80. An outer portion 63 of the lug engaging member 62 extends from the first side 64 of the clamping member 60.

A resilient annular member such as an o-ring 65 is located within a groove about the chamber 80 adjacent the first side 64 of the clamping member 60.

The lug engaging member 62 includes a substantially cylindrical recess 81 extending inwardly of the lug engaging member 62 from a rear end of the lug engaging member 62 adjacent, in use, the rear wall 82 of the chamber 80.

A resilient portion 90 such as a compressible spring is located within the recess 81. In the embodiment of the drawings the resilient portion 90 comprises a plurality of Belleville type cylindrical washers, however it will be appreciated that other resilient elements such as coil springs, rubber or resilient plastic elements could be used.

A substantially cylindrical slot 110 extends from the chamber 80 adjacent a rear end of the lug engaging member 62 to the second side 66 of the clamping member 60. The slot 110 is internally threaded.

The attachment system further includes a stabilizing member 98. The stabilizing member 98 is in the form of a prism, having front and rear faces 100, 102. The stabilizing member 98 is substantially the same shape as the rectangular slot 57.

The stabilizing member 98 has a substantially cylindrical aperture 112 which is arranged to locate, in use, adjacent the slot 110 of the clamping member 60 so as to form a single cylindrical passageway. The cylindrical aperture 112 may be threaded.

A compressing member in the form of a substantially cylindrical bolt 114 is arranged, in use, to locate within the passageway formed by the slot 110 and the aperture 112.

The bolt is externally threaded, and is arranged to engage with the internally threaded slot 110. The bolt acts to hold the stabilizing member 98 relative to the clamping member 60 during use. It will be appreciated that other means may be used to provide a compressive force such as a hydraulically operated piston.

The use of the clamping member 60 will now be described.

Figure 4:
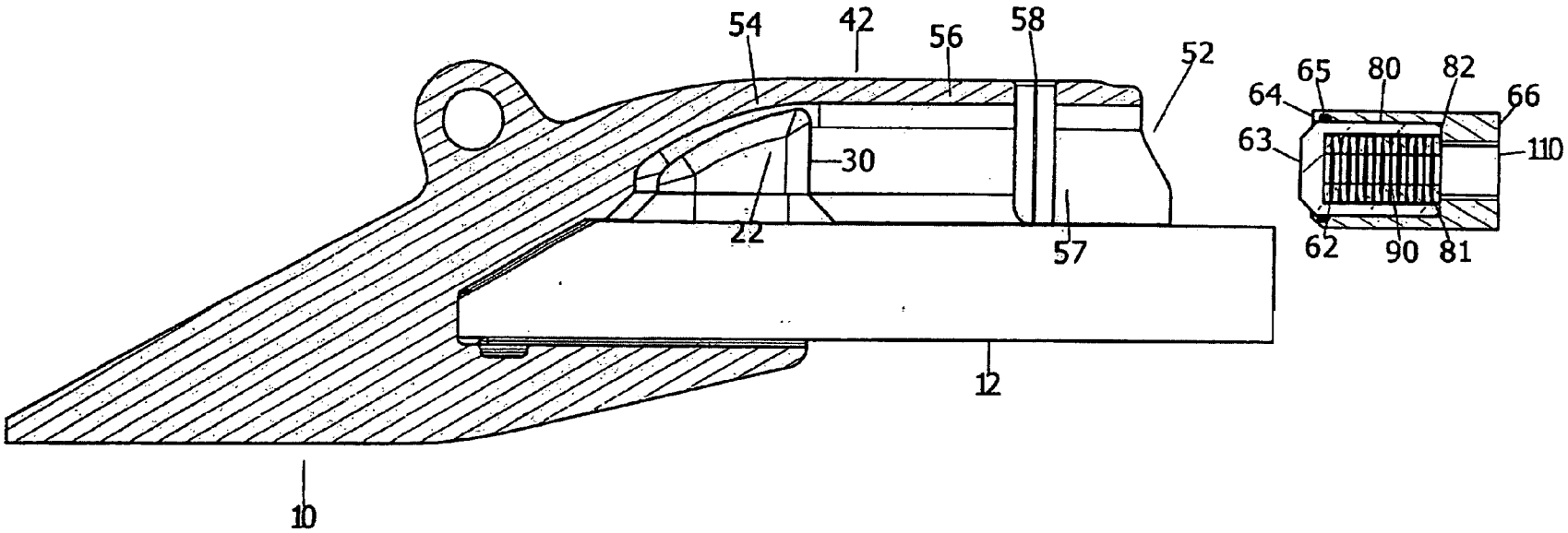
FIGS. 4 to 8 are sequential cross sectional views of a portion of the ground engaging tool and lip plate of FIGS. 1 to 3 during the attachment process.

The attachment portion 42 is positioned over the lip plate 12 with the lug 22 located within the first portion 54 of the engaging recess 50. This is shown in FIG. 4.

The clamping member 60 is then introduced through the rear aperture 52 and slid forward relative to the attachment portion 42 until the first side 64 is adjacent the rear face 30 of the lug 22, and the clamping member 60 is free of the rectangular slot 57.

Figure 5:
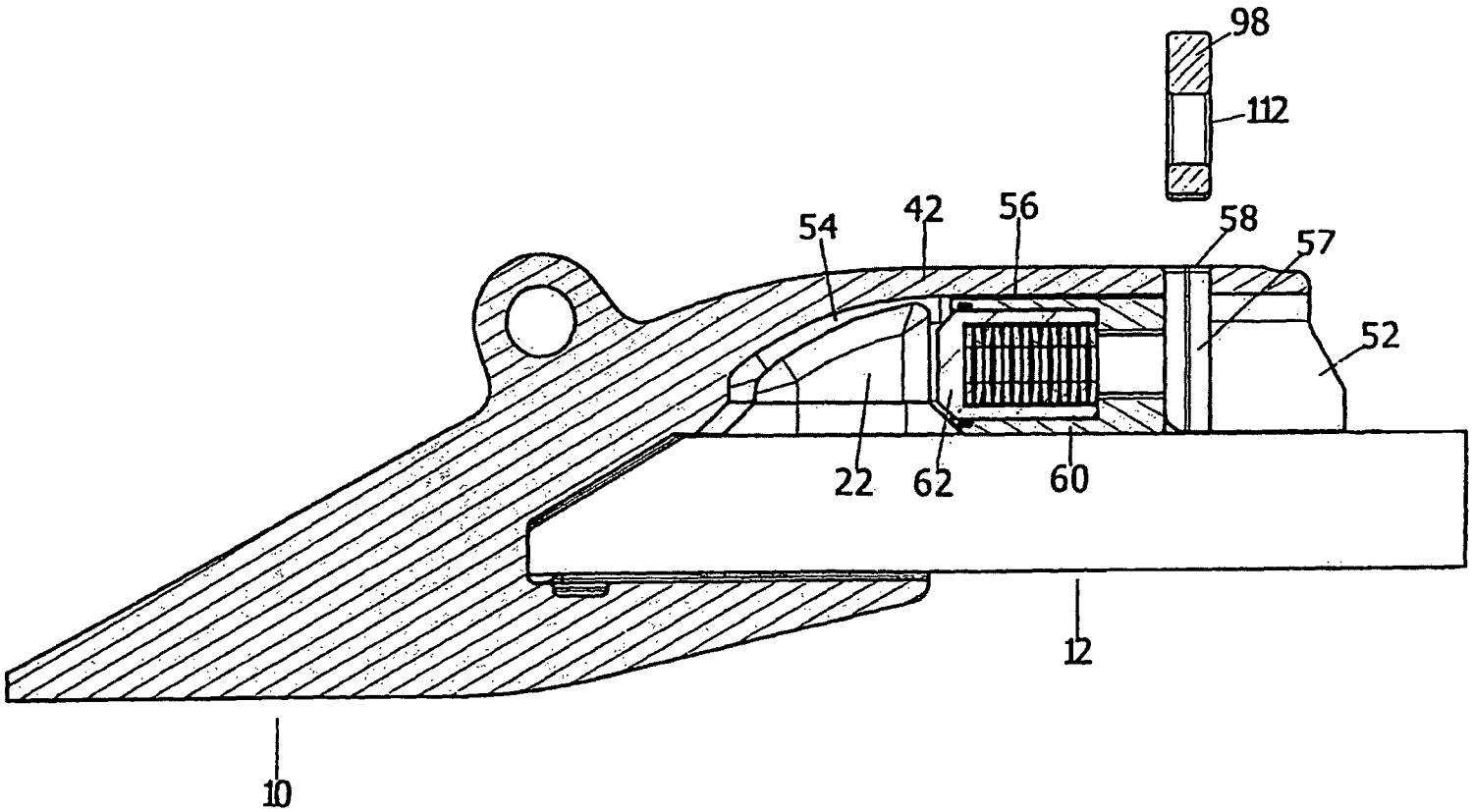

This is shown in FIG. 5.

Figure 6:
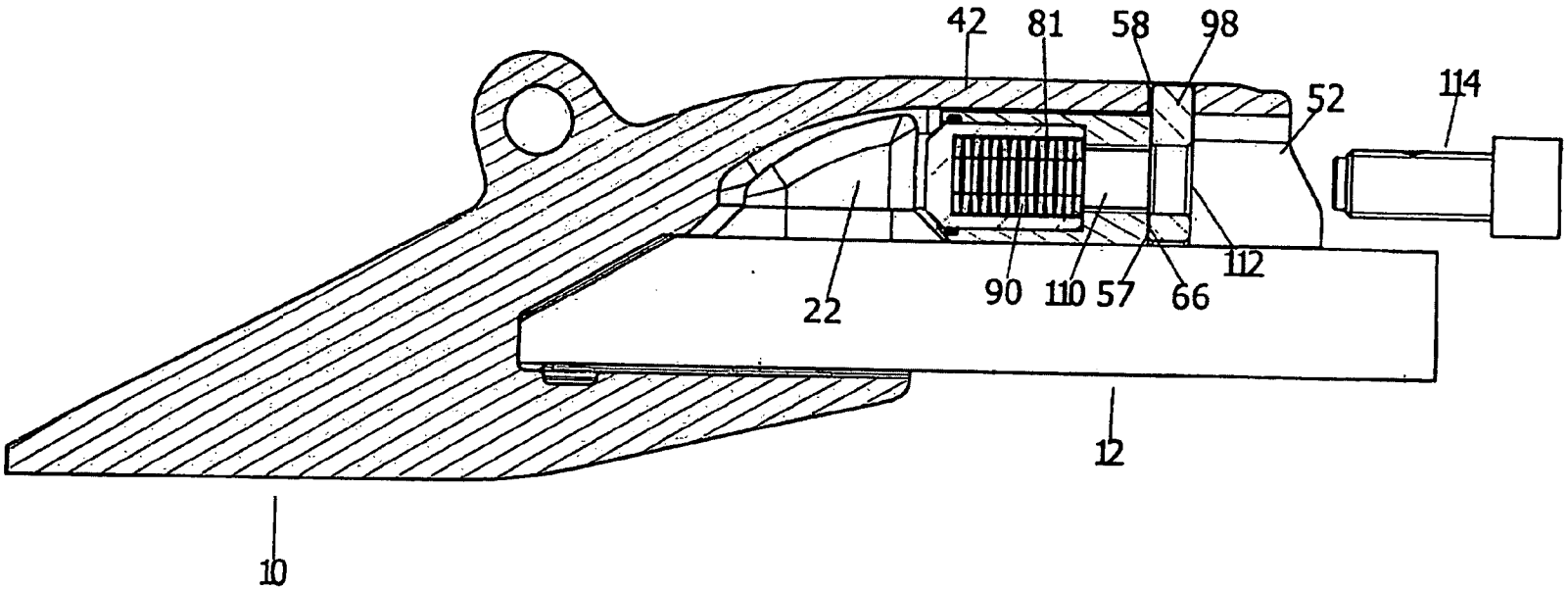

The stabilizing member 98 is then introduced into the aperture 58, and positioned in the rectangular slot 57, between the second side 66 of the clamping member 60 and the rear aperture 52. The presence of the stabilizing member 98 in the slot 57 prevents the movement of the clamping member 60 in the longitudinal direction. This is shown in FIG. 6.

Figure 7:
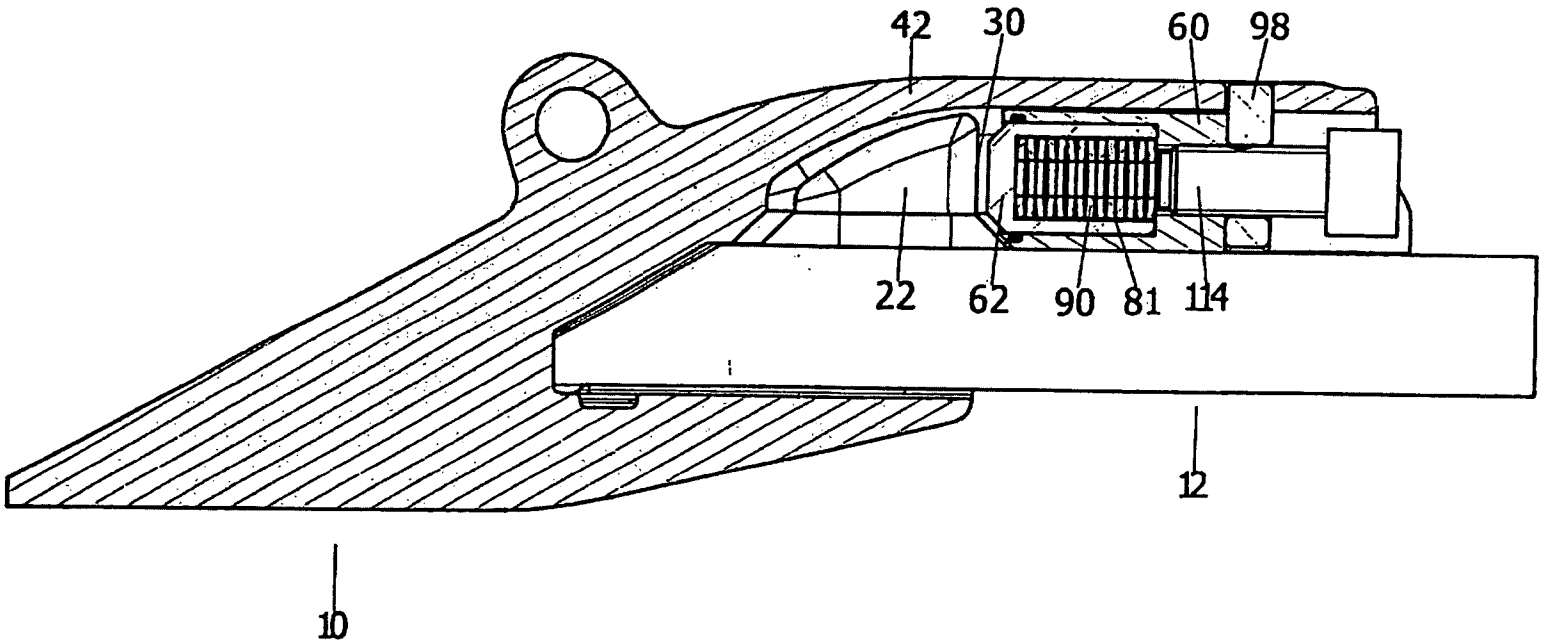

The clamping member is activated as follows. The bolt 114 is introduced into the passage created by the slot 110 and the aperture 112, and is threadedly engaged with the slot 110. When the bolt 114 is fully within this passage, the end of the bolt 114 is adjacent the resilient portion 90. The application of a turning force to the bolt so as to promote the advance of the bolt into the recess 81 provides a compressive force on the resilient portion 90. This is shown in FIG. 7.

Figure 8:
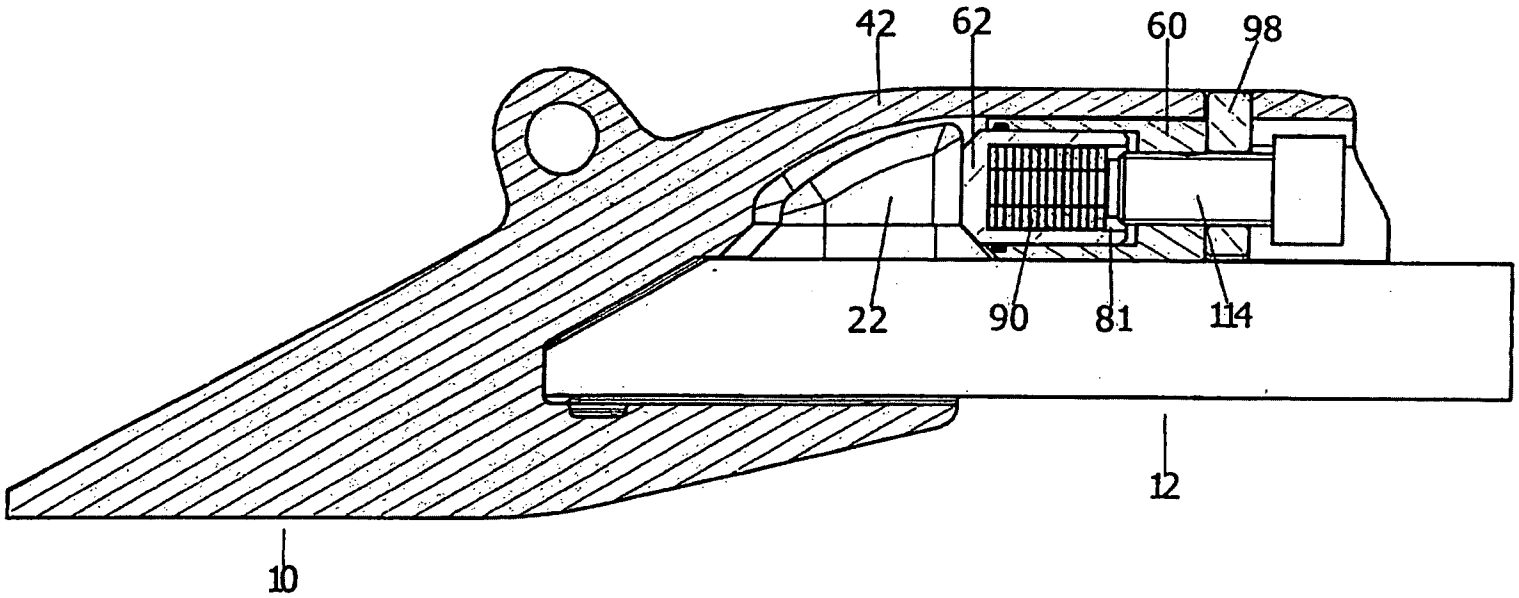

The effect of the compressive force on the resilient portion 90 is to cause lug engaging member 62 to apply a compressive force against the rear face 30 of the lug 22. In this way a compressive force is applied between the lug 22 and the attachment portion 42, thus locking the ground engaging tool 10 in position relative to the lip plate 12. This final position is shown in FIG. 8.

When it is desired to remove the ground engaging tool 10 from the lip portion 12, the bolt 114 is unscrewed from the slot 110, thus releasing the compressive force from the resilient portion 90 of the lug engaging portion 62. The attachment portion 42 can then be readily removed from the lip portion 12 in the reverse of the above process, potentially allowing some members to be reused.

The applicant has done further experimental work on failure mechanisms of this arrangement. During use, the ground engaging tool 10 may be subject to forces which result in stresses on components of the attachment system which are beyond their yield strength. This results in deformation of those components.

It will be appreciated that the stress concentrations caused will be largely dictated by the geometry of the components concerned. It will also be appreciated that the yielding point will be a combination of both the stress applied and the component hardness.

The present invention proposes arranging the components in such a way that yielding occurs in the protruding part of the lug engaging member 62, adjacent the outer edge 63. This can be achieved through a combination of a number of mechanisms, including appropriate choice of materials for the various components, appropriate hardness treatments, and appropriate design of the relevant geometry such that particularly high stress concentrations in the threads and against the stabilizing member are avoided. In particular it is important to design and treat both the internal threads of the body 61 and the external threads of the bolt 114 so that the protruding part of the lug engaging member 62 deforms in preference to the threads.

Figures 9, 9A:
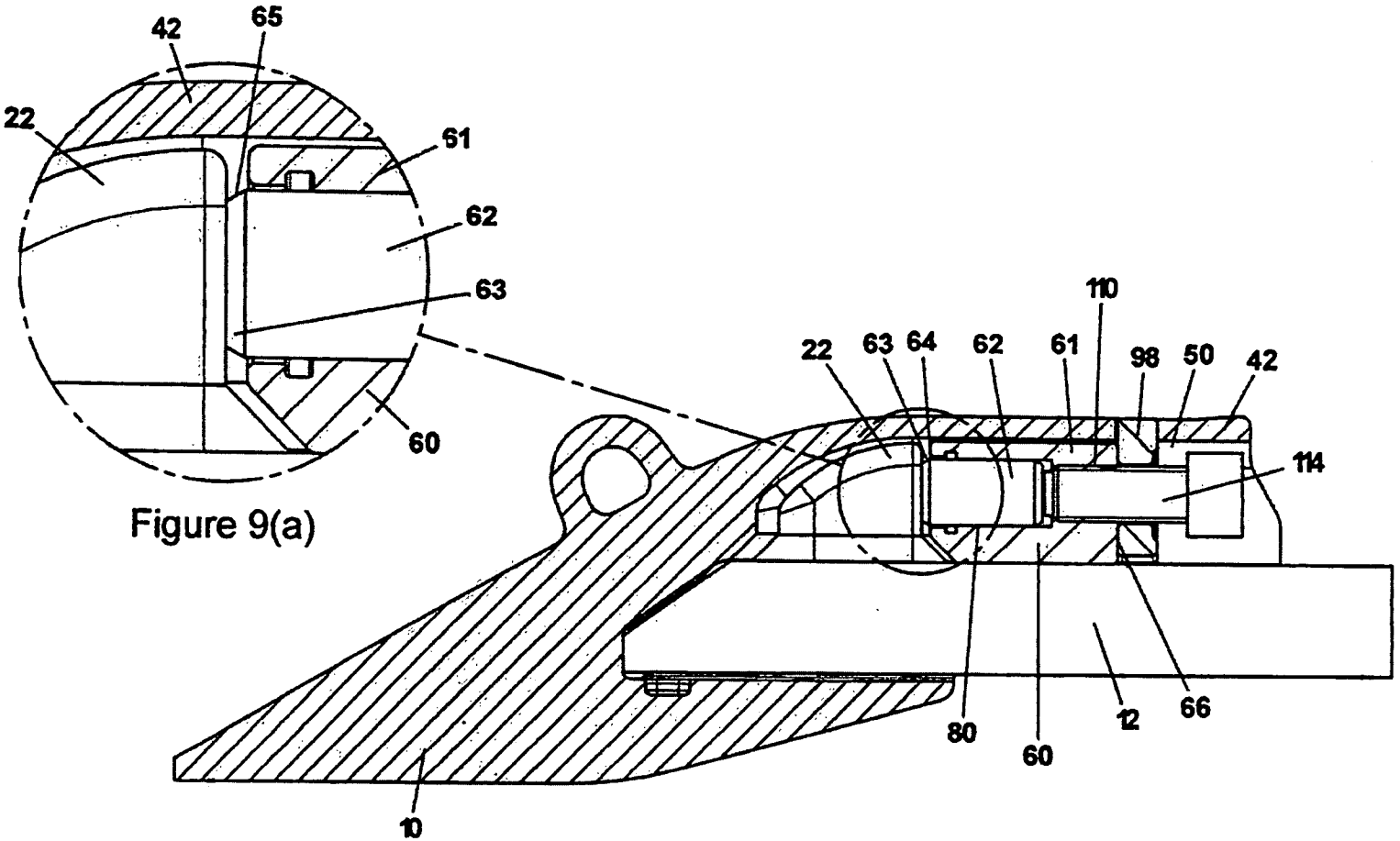
FIG. 9 is a cross-sectional view of an alternative ground engaging tool connected to a bucket lip using an attachment system in accordance with the present invention.
FIG. 9*a* is an enlarged portion of a region of FIG. 9.
Figures 10, 10A:
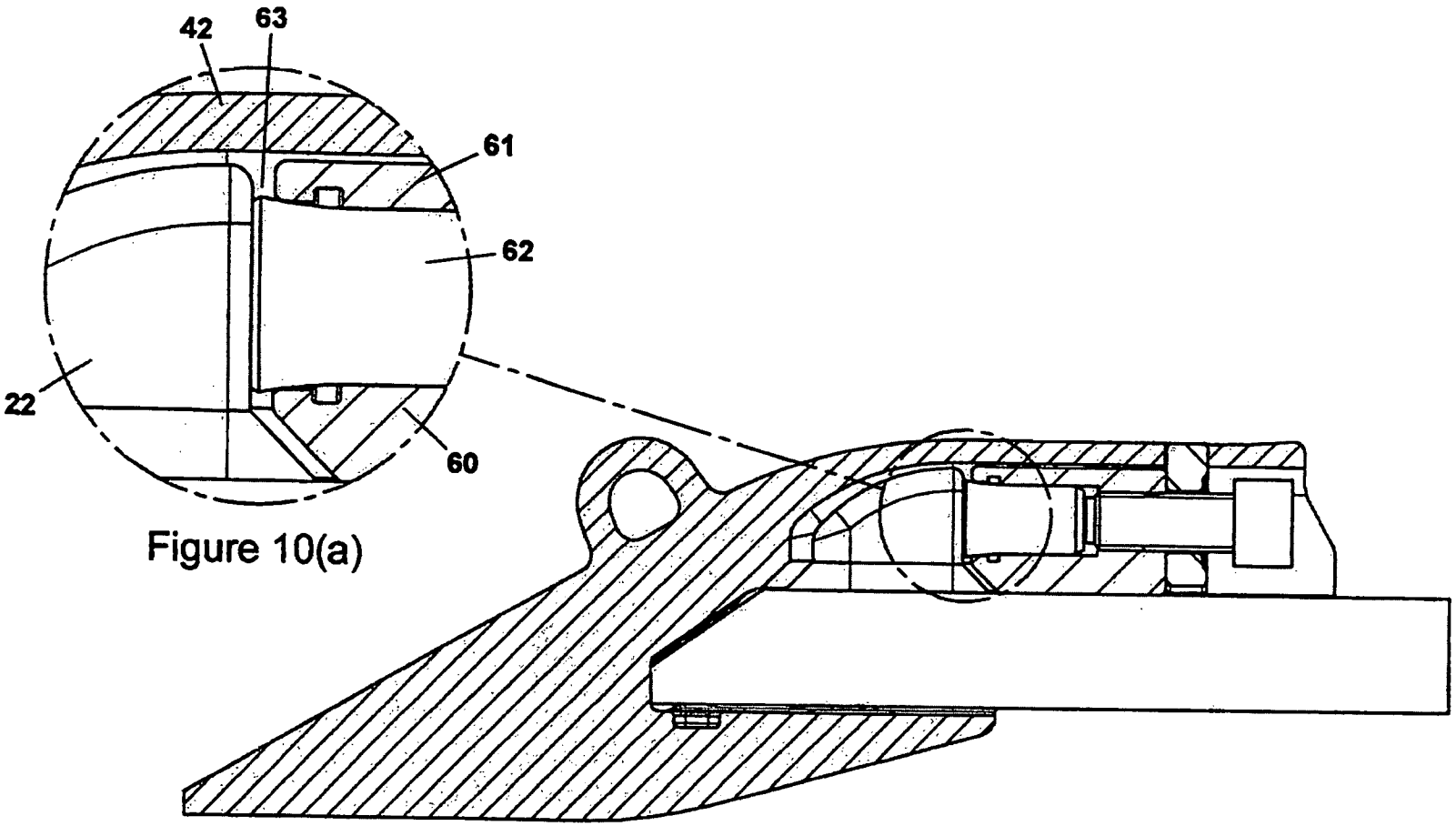
FIG. 10 is a cross-sectional view of the arrangement of FIG. 9, shown after plastic deformation within the attachment system.
FIG. 10*a* is an enlarged portion of a region of FIG. 10.

FIGS. 9 and 10 show an alternative arrangement of the attachment means of the present invention, in which the lug engaging member acts as a resilient member without requiring the addition of Belleville washers or similar.

When yielding occurs, the resulting deformation can be seen in FIG. 10. The effect is a 'mushrooming' of the lug engaging member 62. The result of this mushrooming will be that the lug engaging member 62 will not be able to be withdrawn into the chamber 80. Nonetheless, the bolt 114 will still be able to be tightened, to restore the required clamping force, and will also be able to be removed, allowing for removal of the stabilizing member 98 and the clamping member 60. The ground engaging tool 10 can then be removed and replaced as required.

If reuse of the clamping member 60 is desired, it will be simple to remove the deformed lug engaging member 62 by the simple expedient of pulling out the deformed member 62, or by advancing the bolt 114 through the chamber 80 after the clamping member 60 has been removed from the ground engaging tool 10. A new lug engaging member 62 can then be pushed into position.

In the embodiment of the drawings, it will be seen that the lug engaging member 62 has a bevel 65 about the outer edge 63. One advantage of this is that a small degree of deformation will not affect use of the clamping member 60. Only deformation which has the effect of expanding the diameter of the outer edge 63 beyond that of the chamber 80 will cause the device to be deformed beyond the point where the lug engaging member can be withdrawn into the chamber 80. Small deformations will thus not prevent the ready re-use of the device.

Modifications and variations as would be apparent to a skilled addressee are deemed to be within the scope of the present invention.

The invention claimed is:

1. A ground engaging tool attachment system for releasably attaching a ground engaging tool to a bucket for mining or earth moving equipment, the system comprising:

a clamping member comprising a body, a mechanically actuated force applying member and a compressing member positioned within the body, the compressing member having an axis and a first portion at a first side of the body, wherein an application of force by mechanically actuating the force applying member causes the first portion of the compressing member to protrude from the first side of the body, and wherein relative hardnesses of the body, the force applying member and the compressing member are such that the application of an axially applied force to the protruding first portion of the compressing member along an axis of the compressing member will preferentially cause deformation of the protruding first portion of the compressing member in the same axis as the applied force ahead of deformation of the body or the force applying member; and a stabilizing member removably attached to the clamping member to prevent longitudinal movement of the clamping member when application of the axially applied force causes the first portion of the compressing member to protrude from the first side of the body.

2. The attachment system of claim 1, wherein the force applying member is located in a threaded connection extending internally of a second side of the body, the second side of the body being opposite the first side.

3. The attachment system of claim 2, wherein the force applying member is substantially axially aligned with the compressing member.

4. The attachment system of claim 1, wherein the compressing member is substantially cylindrical in shape.

5. The attachment system of claim 4, wherein the compressing member has a bevelled outer edge, located within the protruding first portion of the compressing member.

6. An attachment system for connecting a ground engaging tool to a bucket lip, the system comprising:

a lug attached to the bucket lip;

a ground engaging tool defining a recess to receive the lug;

a clamping member being disposed between the lug and the ground engaging tool, the clamping member having a body, a force applying member and a compressing member positioned within the body, the compressing member having an axis and a first portion at a first side of the body, wherein an application of force by the force applying member causes the first portion of the compressing member to protrude from the first side of the body and to engage the lug, and wherein relative hardnesses of the lug, the body, the force applying member and the compressing member are such that the application of an axially applied force via the lug to the protruding first portion of the compressing member along an axis of the compressing member will preferentially cause deformation of the protruding first portion of the compressing member in the same axis as the applied force ahead of deformation of the body or the force applying member; and a stabilizing member positioned in the recess and removably attached to the clamping member to transfer force applied by the clamping member to a rear portion of the ground engaging tool.

7. The attachment system as claimed in claim 6, wherein the compressing member further includes a second portion comprising a resilient portion, wherein a supply of a compressive force to the resilient portion acts to restrain movement of the first portion of the compressing member relative to the lug.

8. The attachment system as claimed in claim 7, wherein the resilient portion is contained within the lug engaging member.

9. The attachment portion as claimed in claim 8, wherein the resilient portion is a compressible spring.

10. The attachment portion as claimed in claim 8, wherein the resilient portion is comprised of a plurality of Belleville washers.

11. An attachment system for connecting a ground engaging tool to a bucket lip, the system comprising:

a lug attached to the bucket lip;

a recess defined in the ground engaging tool to receive the lug;

a clamping member being disposed between the lug and the ground engaging tool, the clamping member having a body, a force applying member and a compressing member positioned within the body, the compressing member having an axis and a first portion at a first side of the body, wherein an application of force by the force applying member causes the first portion of the compressing member to protrude from the first side of the body and to engage the lug, and wherein relative hardnesses of the lug, the body, the force applying member and the compressing member are such that the application of an axially applied force via the lug to the protruding first portion of the compressing member along an axis of the compressing member will preferentially cause deformation of the protruding first portion of the compressing member in the same axis as the applied force ahead of deformation of the body or the force applying member; and a stabilizing member positioned in a slot of the recess, wherein the recess extends inwardly from a rear surface of the ground engaging tool, wherein the clamping member is receivable within the recess from the rear surface, the clamping member being positionable adjacent the lug, wherein the stabilizing member is positioned, during use, between the clamping member and the rear surface, and wherein the supply of pressure to the clamping member acts to restrain movement of the ground engaging tool relative to the lug.

12. The attachment system as claimed in claim 11, wherein the stabilizing member is arranged within the slot and is prevented from moving in a longitudinal direction.

13. The attachment system as claimed in claim 11, wherein the stabilizing member includes an aperture through which the pressure can be applied.

* * * * *